US008087365B2

(12) United States Patent
Levy et al.

(10) Patent No.: US 8,087,365 B2
(45) Date of Patent: Jan. 3, 2012

(54) TABLE FURNITURE CONFIGURABLE INTO THREE SEPARATE ARRANGEMENTS AND MODES OF USE

(76) Inventors: Davida Levy, Aventura, FL (US); Carole Posner, Boca Raton, FL (US)

( * ) Notice: Subject to any disclaimer, the term of this patent is extended or adjusted under 35 U.S.C. 154(b) by 592 days.

(21) Appl. No.: 12/248,446

(22) Filed: Oct. 9, 2008

(65) Prior Publication Data

US 2009/0095204 A1 Apr. 16, 2009

Related U.S. Application Data

(60) Provisional application No. 60/978,805, filed on Oct. 10, 2007.

(51) Int. Cl.
*A47B 7/00* (2006.01)

(52) U.S. Cl. ..... 108/91

(58) Field of Classification Search ..... 108/91, 108/90, 33, 64, 17, 11; 312/277, 203
See application file for complete search history.

(56) References Cited

U.S. PATENT DOCUMENTS

| | | | | | |
|---|---|---|---|---|---|
| 1,086,941 | A | * | 2/1914 | Sarkoze | 108/70 |
| 1,227,681 | A | * | 5/1917 | Simms | 108/91 |
| 1,881,475 | A | * | 10/1932 | Gibson | 108/106 |
| D143,454 | S | * | 1/1946 | white | D6/484 |
| D159,539 | S | | 8/1950 | Schier et al. | |
| 2,924,830 | A | * | 2/1960 | De Long | 5/8 |
| 3,742,869 | A | | 7/1973 | Polsky et al. | |
| D236,054 | S | | 7/1975 | Ginat | |
| 4,345,758 | A | * | 8/1982 | Kempf | 473/475 |
| D284,340 | S | | 6/1986 | Berry, Jr. | |
| D284,431 | S | | 7/1986 | Berry, Jr. | |
| D295,815 | S | | 5/1988 | Beall, Jr. | |
| D343,072 | S | | 1/1994 | Schulman et al. | |
| 5,341,750 | A | | 8/1994 | Fuchs | |
| 5,485,795 | A | | 1/1996 | Williams | |
| 5,564,345 | A | | 10/1996 | Crawford et al. | |
| 5,595,126 | A | * | 1/1997 | Yeh | 108/64 |
| D386,020 | S | | 11/1997 | Grabowski | |
| 5,754,995 | A | | 5/1998 | Behrendt | |
| D401,438 | S | | 11/1998 | Acinapura et al. | |
| D401,790 | S | | 12/1998 | Buell | |
| D447,891 | S | | 9/2001 | Wood et al. | |
| D525,806 | S | | 8/2006 | Lai | |
| 7,107,914 | B2 | | 9/2006 | Sherman | |
| 7,373,889 | B2 | | 5/2008 | Nye et al. | |

FOREIGN PATENT DOCUMENTS

| | | | |
|---|---|---|---|
| CH | 562586 | * | 6/1975 |
| WO | WO 02/01986 | * | 1/2002 |

* cited by examiner

*Primary Examiner* — Janet M Wilkens
(74) *Attorney, Agent, or Firm* — Mayback & Hoffman, P.A.; Gregory L. Mayback; Rebecca A. Tie

(57) ABSTRACT

A configurable table (100) includes a first table portion (102) and a second table portion (104). The first table portion includes a first upper region (106) and a first plurality of leg members disposed perpendicular to the first upper region. The second table portion includes a second upper region (108) and a second plurality of leg members disposed perpendicular to the second upper region. At least one leg member from each of the first and second pluralities of leg members are matched to each other. One of each two matched leg members includes a channeled portion along the length of the leg member. The other matched leg member includes a mating portion such that the channeled portion and the mating portion mate with each other. A method of configuring a table into two separate tables, and vice versa, is provided.

20 Claims, 8 Drawing Sheets

TABLE FURNITURE CONFIGURABLE INTO THREE SEPARATE ARRANGEMENTS AND MODES OF USE

CROSS REFERENCE TO RELATED APPLICATION

The present patent application is related to, and claims priority to commonly owned U.S. Provisional Patent Application No. 60/978,805, entitled "Convertible Two-in-One Table", filed on Oct. 10, 2007, the entire teachings of which being hereby incorporated by reference.

FIELD OF THE INVENTION

The present invention generally relates to the field of furniture, and more particularly relates to a configurable table.

BACKGROUND OF THE INVENTION

Conventional expandable tables generally require a separate leaf to be added or have foldable portions in order to expand the size of the table. Separate leafs are cumbersome and usually need to be stored away. Conventional tables that utilize one or more foldable sides can generally only increase the size of a table a relatively small amount. Also, because the sides are foldable, the edges of the non-foldable portion that adjoin with the foldable portions generally cannot have decorative carvings, moldings, or other configurations. Therefore, these types of tables can be aesthetically unpleasing when in a folded configuration.

SUMMARY OF THE INVENTION

In one embodiment, a convertible table comprises a first table portion and a second table portion. The first table portion comprises a first upper region and a first plurality of leg members. Each leg member of the first plurality of leg members is disposed perpendicular to the first upper region and extends from an underside of the first upper region. The second table portion comprises a second upper region and a second plurality of leg members. Each leg member of the second plurality of leg members is disposed perpendicular to the second upper region and extends from an underside of the second upper region. At least one leg member of the first plurality of leg members and at least one leg member of the second plurality of leg members are matched to each other. One of each two matched leg members comprises a channel portion along the length of the leg member. The other one of the respective two matched leg members comprises a mating portion along the length of the leg member such that the channel portion and the mating portion are configured and oriented to mate with each other.

In another embodiment, a convertible table includes a first table portion and a second table portion. The first table portion comprises a first upper region and the second table portion comprises a second upper region. In a first mode of configuration of the convertible table, the first upper region is situated on the second upper region. The first table portion comprises a plurality of leg members disposed perpendicular to the first upper region and extending from an underside of the first upper region. Each leg member of the second table portion comprises a mating portion along the length of the leg member such that the channeled portion and the mating portion are configured to mate with each other.

In yet a further embodiment, a method of configuring a table into two separate tables, and vice versa is disclosed. The method comprises sliding a first portion of a first table away from a second portion of the first table. The first table being disposed on top of a second table. Each of the first table and the second table includes a plurality of leg members disposed perpendicular to an upper table region of the respective first table and second table and the plurality of leg members extending from an underside of the upper table region. One of the plurality of leg members of the first table and the second table is removed from the other corresponding plurality of leg members of the first table and the second table. The removing comprises separating a mating portion of at least one leg member of the plurality of leg members of one of the first table and the second table from a channeled portion of at least one leg member of the plurality of leg members of the other one of the first table and the second table. The first table is lifted from the second table after the removing. The first table and the second table are placed on a flooring surface after the lifting in one of a non-adjacent configuration creating two separate and distinct tables and adjacent to each other. In the adjacent configuration an edge portion of the upper table region of the first table and an edge portion of the upper table region of the second table substantially abut each other thereby creating a single larger table.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention, in which.

DETAILED DESCRIPTION

As required, detailed embodiments of the present invention are disclosed herein; however, it is to be understood that the disclosed embodiments are merely examples of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure and function. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Figure 1:
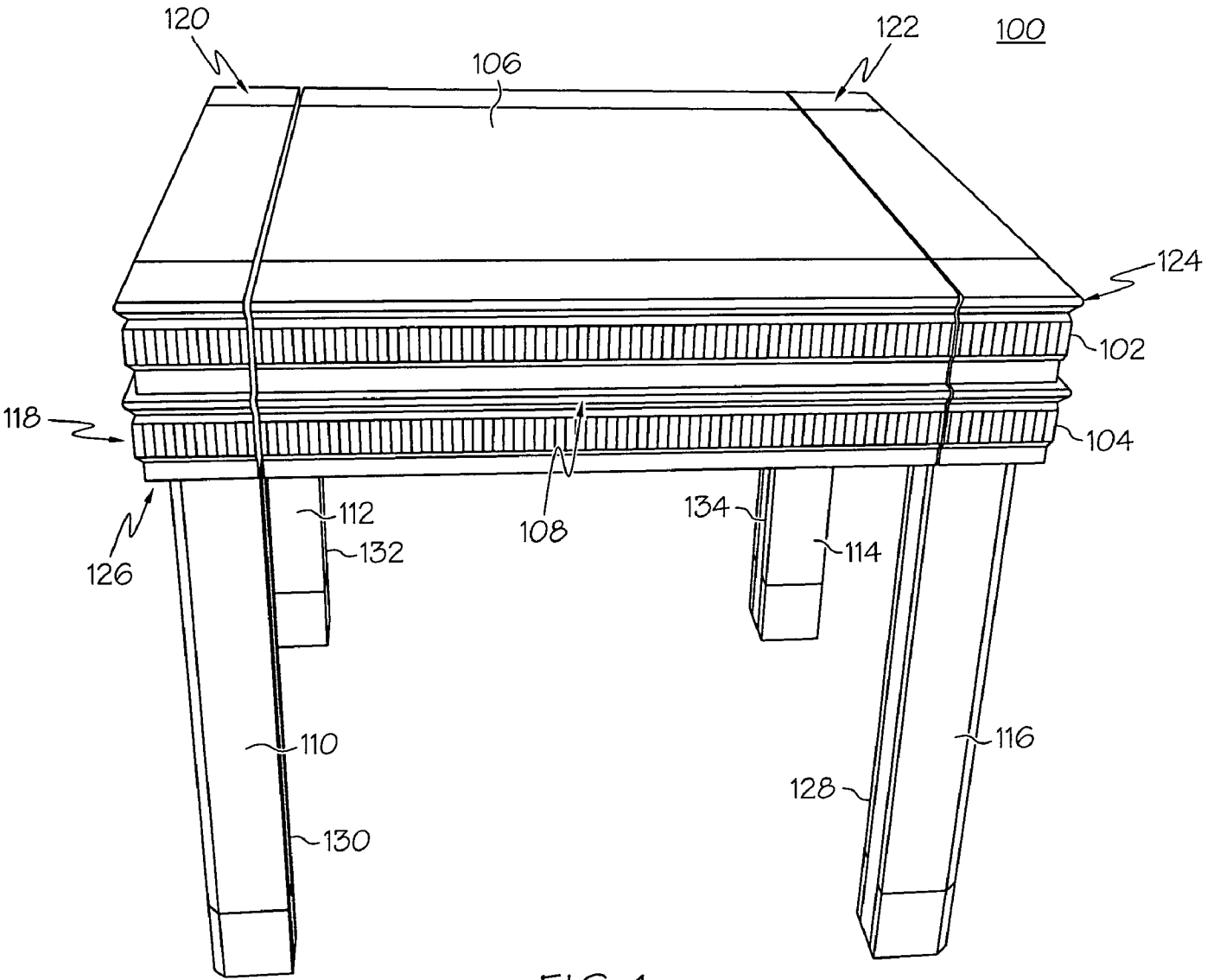
FIG. 1 is a perspective view of a convertible table in a non-expanded single table configuration, according to one embodiment of the present invention.

FIG. 1 shows a convertible table 100 according to one embodiment of the present invention. The convertible table 100, as will be discussed in greater detail below, is advantageous over conventional tables because one or more separate leaves, which would need to be stored away, are not required. Another advantage is that the surface area of the table 100 is able to be substantially increased (e.g. double in size) while maintaining ease of use and a relatively small foot-print. For example, conventional tables that utilize one or more foldable sides can generally only increase the size of a table a relatively small amount. Also, because the sides are foldable, the edges of the non-foldable portion that adjoin with the foldable portions generally cannot have decorative carvings, moldings, or other configurations. Therefore, these types of tables can be aesthetically unpleasing when in a folded configuration. The convertible table 100, on the other hand, can substantially increase in size without the use of a leaf and/or foldable sides and can also have decorative edges as well. Also, the convertible table 100 saves space by enabling two separate tables 402, 404 (FIG. 4) to be mated together creating a single unified table 100.

In particular, FIG. 1 shows the convertible table 100 comprising a first table portion 102 and a second table portion 104. The first table portion 102, in one embodiment, is situated (or mounted) on top of the second table portion 104 when the table 100 is in a non-side-by-side or separate configuration. As will be discussed in greater detail below, the first table portion 102, in one embodiment, also can be separately configured as a first table 402 (FIG. 4) and the second table portion 104, in one embodiment, also can be separately configured as a second table 404 (FIG. 4) that is separate and distinct from the first table 402. These two tables 402, 404 can be adjoined, abutted side by side to each other, to create a single expanded table configuration 702 (FIG. 7) that is much larger than the convertible table 100 in a non-expanded configuration.

The first table portion 102 and the second table portion 104 include an upper region 106, 108, as shown in FIG. 1. The upper regions 106, 108 are generally the regions of a table that are used as a dining surface, a surface to place items such as decorations, or the like. The upper regions 106, 108 can each have substantially similar lengths and/or widths such that when the convertible table 100 is in a non-expanded configuration, as shown in FIG. 1, the upper region 106 of the first table portion 102 is substantially flush with the upper region 108 (and 208 of FIG. 2) of the second table portion 104. However, in another embodiment, each of the upper regions 106, 108 can have different lengths and/or widths to create a non-flush configuration between the upper regions 106, 108.

The first table portion 102, in one embodiment, includes a plurality of leg members 110, 112, 114, 116. Each of the leg members 110, 112, 114, 116 is disposed at a separate corner region 118, 120, 122, 124 of the first table portion 102. Each leg member 110, 112, 114, 116 is situated perpendicular to the upper region 106 of the first table portion 102 and extends in an outward direction from an underside 126 of the upper region 106. It should be noted that the leg members 110, 112, 114, 116 of the first table portion 102 are not required to be disposed in the corner regions 118, 120, 122, 124 of the first table portion 102.

Figure 2:
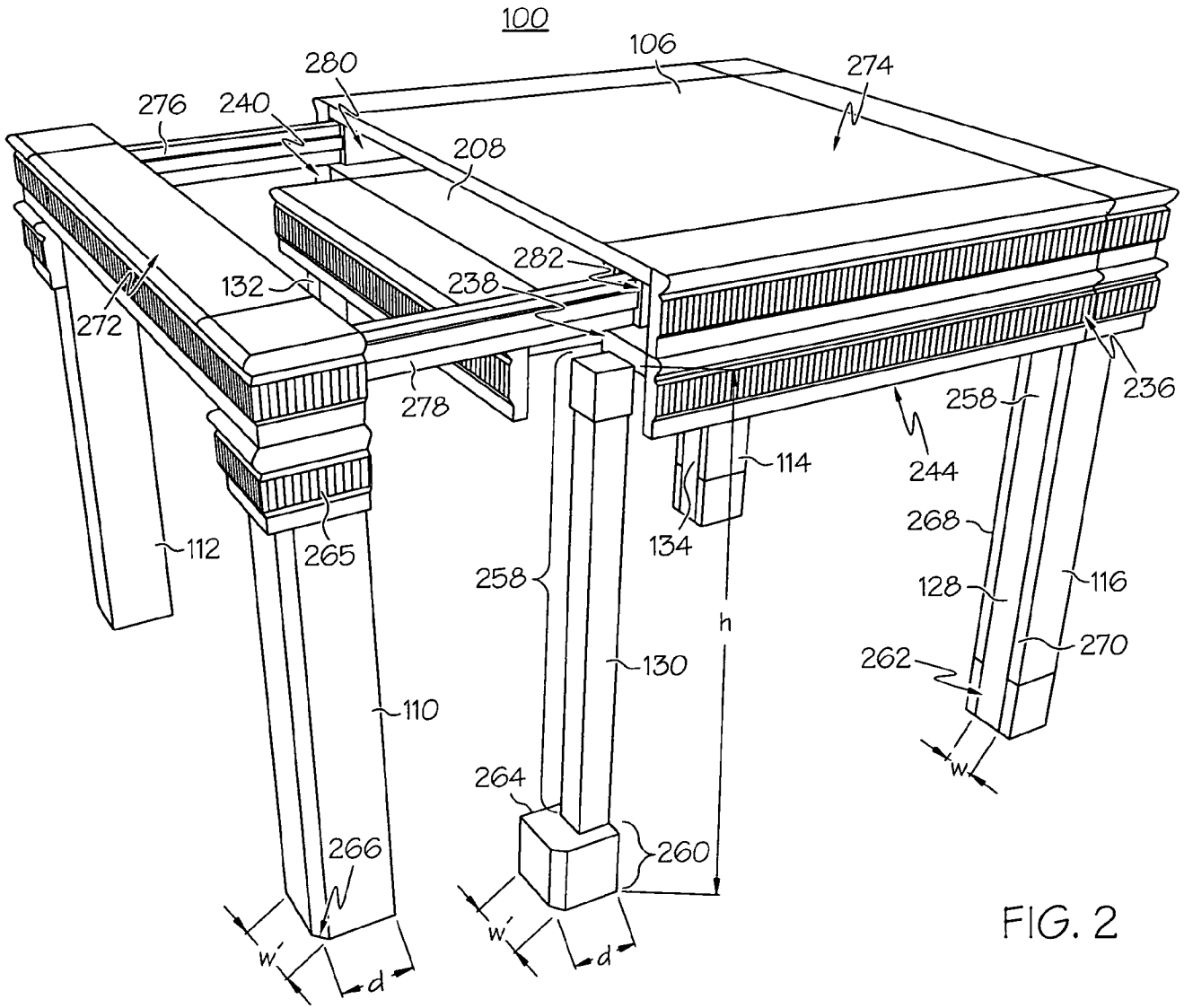
FIG. 2 is a perspective view of the convertible table of FIG. 1 showing a first table portion in a partially expanded configuration and being mounted on a second table portion.

The second table portion 104 also includes a plurality of leg members 128, 130, 132, 134, as shown in FIG. 1 and in greater detail in FIG. 2. Each of the leg members 128, 130, 132, 134 of the second table portion 104 are disposed at a separate corner region 236, 238, 240, 242 (not all shown in FIG. 2; see also FIG. 5) of the second table portion 104. Each leg member 128, 130, 132, 134 is situated perpendicular to the upper region 208 (and 108 FIG. 1) of the second table portion 104 and extends in an outward direction from an underside 244 of the upper region 208. It should be noted that the leg members 128, 130, 132, 134 of the second table portion 104 are not required to be disposed in the corner areas 236, 238, 240, 242 (not shown) of the second table portion 104.

Figure 3:
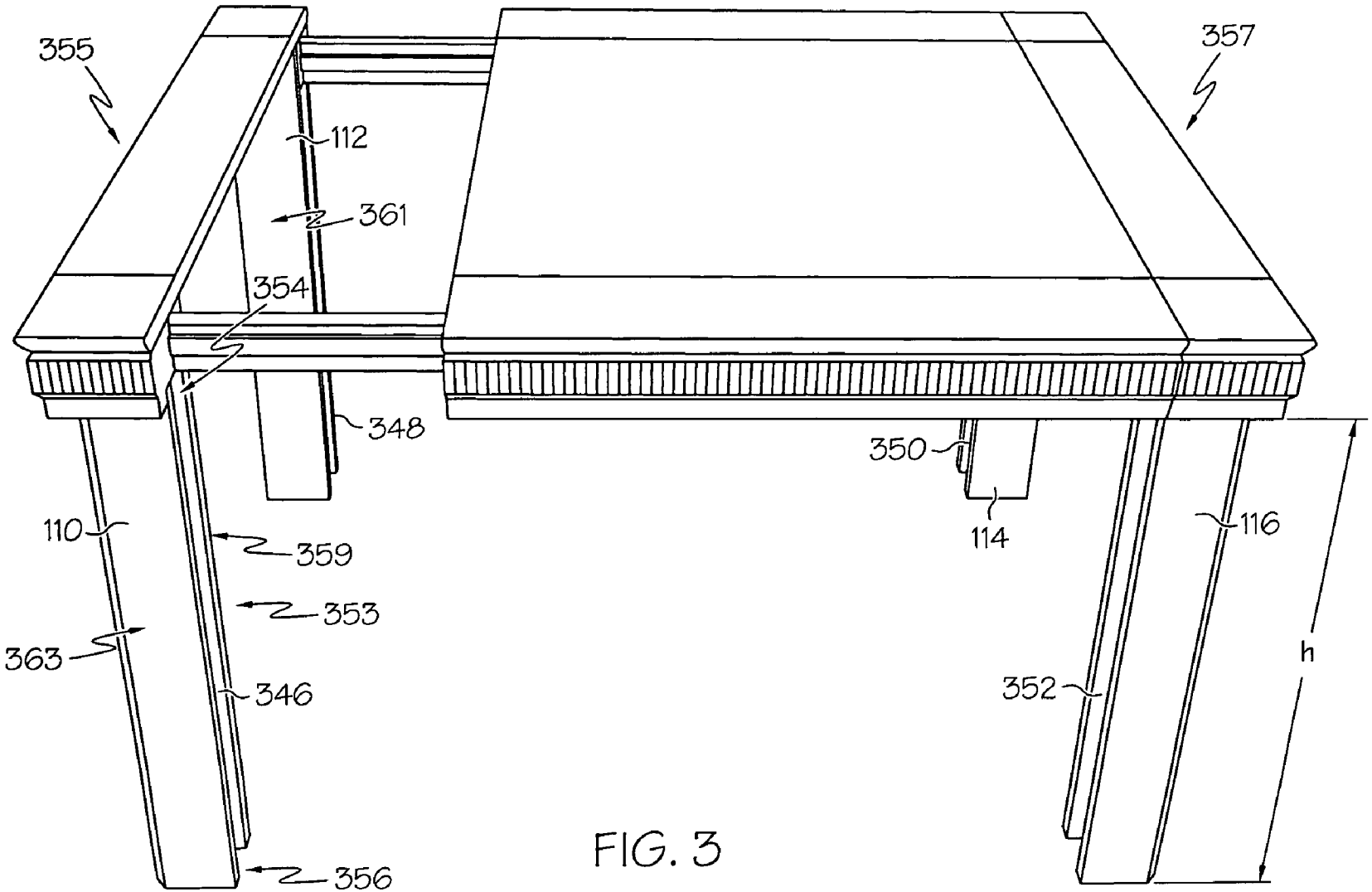
FIG. 3 is a perspective view of the convertible table shown in FIG. 2, with the first table portion in a partially expanded configuration being viewed from a different angle than that shown in FIG. 2.

In one embodiment, the leg members 110, 112, 114, 116 of the first table portion 102 and the leg members 128, 130, 132, 134 of the second table portion 102 are configured to match and mate with each other as shown in FIG. 1. For example, each of the leg members 110, 112, 114, 116 of the first table portion 102 includes a channeled portion (or can also be a hollowed, grooved, pocketed, or slotted portion) 346, 348, 350, 352 as shown in FIG. 3. In this embodiment, each of the channeled portions 346, 348, 350, 352 are configured to accept a corresponding leg member 128, 130, 132, 134 of the second table portion 104. However, it should be noted that even though the following discussion is directed to the channeled portions being disposed on the first table portion leg members and the second table portion leg members being inserted/mated therewith, the second table portion leg members can include the channeled portions and the first table portion leg members can be inserted/mated therewith as well.

In one embodiment, the channels 346, 348, 350, 352, (see FIG. 3) are disposed along substantially the entire region between a top portion 354 and a bottom portion 356 of each respective leg member 110, 112, 114, 116. The channeled portions 346, 348, 350, 352, in one embodiment, are disposed on a side 353 of each leg member 110, 112, 114, 116 that faces an opposing leg member disposed on an opposite side of the first table portion 102.

For example (and for illustration purposes only) assume that leg members 110 and 112 are disposed on a first side 355 of the first table portion 102 and that leg members 114 and 116 are disposed on an opposite side 357 of the first table portion 102. The channeled portions 346 and 348 of leg members 110 and 112 face leg members 116 and 114 respectively, and vice versa, as shown in FIG. 3. Alternatively, the channeled portion 346 of leg member 110 can also be disposed on a side 359 that faces leg member 112 while the channeled portion 348 of leg member 112 is disposed on a side 361 that faces leg member 110. In yet another embodiment the channeled portion 346 of leg member 110 can be disposed on a side 363 that faces outward from the first table portion while the channeled portion 348 of leg member 112 is disposed on the side 361 that faces leg member 110, or vice versa. It should be noted that similar channeled portion 350, 352 configurations are also applicable to the other leg members 114 and 116.

Also, the orientation used above is only illustrative and leg members and 110 and 116 can be considered to be on the same side of the first table portion 102 while leg members and 112 and 114 are on a same side of the first table portion 102 that is opposite from the side where leg members 110 and 116 are disposed. In this embodiment, the channeled portion 346, 348 configurations discussed above with respect to leg members 110 and 112 are applicable to leg members 110 and 116 and similarly to leg members 112 and 114.

Each channeled portion 346, 348, 350, 352 is configured to accept a corresponding leg member 128, 130, 132, 134 of the second table portion 104. For example, FIG. 2 shows that each leg member 128, 130, 132, 134 of the second table portion 104 includes a first leg portion 258 and a second leg portion 260. The first leg portion 258 is configured such that the first leg portion 258 is mateable and/or insertable into the channeled portion 346, 348, 350, 352 of a corresponding leg member 110, 112, 114, 116 of the first table portion 102. For example, the width w of the first leg portion 258 of the leg members 128, 130, 132, 134 is configured so that first leg portion 258 is mateable/insertable into the channeled portions 346, 348, 350, 352 of the corresponding first table portion leg member 110, 112, 114, 116. FIG. 2 shows one example of this embodiment by having the leg member 128 of the second portion table 102 inserted into the channeled portion 352 (not shown in FIG. 2) of leg member 116 of the first table portion 102.

Figure 4:
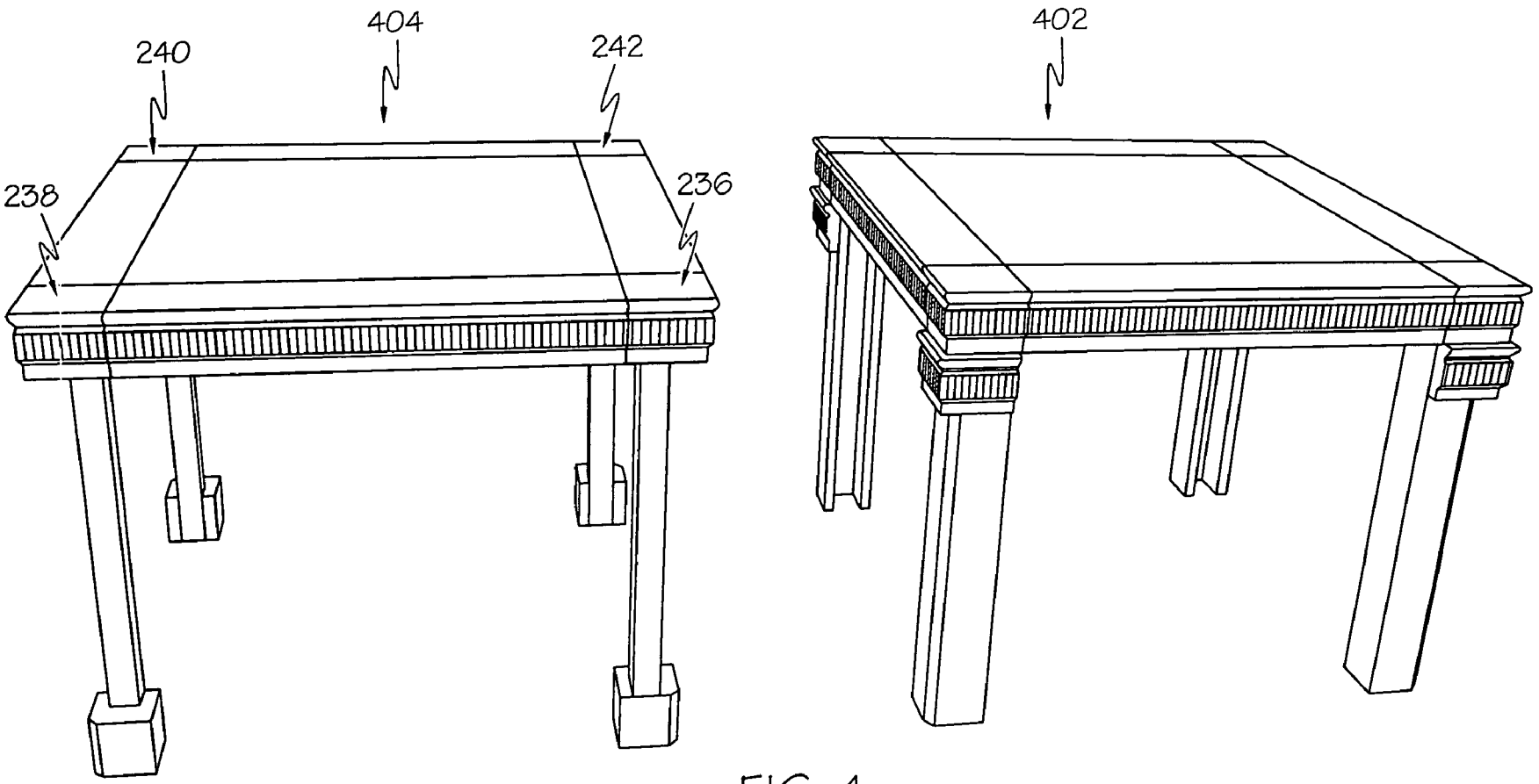
FIG. 4 is a perspective view of the convertible table shown in FIG. 2, with the first table portion and the second table portion shown separated from each other in a two separate table configuration, according to one embodiment of the present invention.
Figure 7:
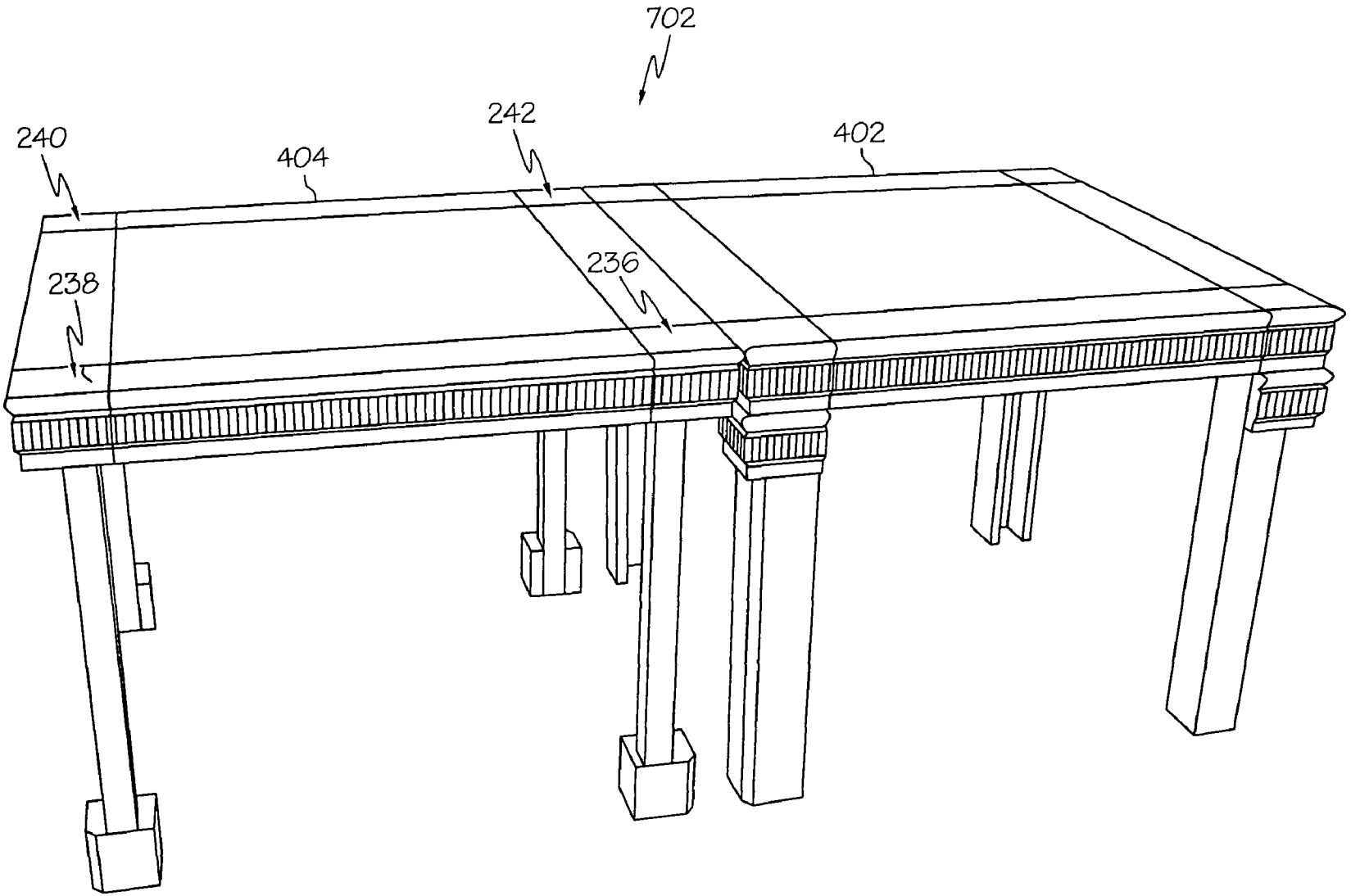
FIG. 7 is a perspective view of the convertible table shown in FIG. 4, with the first table portion and the second table portion shown adjacent to each other in an expanded single table configuration, according to one embodiment of the present invention.

The second leg portion 260 of each 128, 130, 132, 134 is disposed under the first leg portion 258 and, in one embodiment, shares a common face 262 with the first leg portion 258. The second leg portion 260 includes a width w and a depth d that is substantially similar to a width w and a depth d of the corresponding first table portion leg member 110. Also, the height h of the second table portion leg members 128, 130, 132, 134 is substantially similar to the height h of the first table portion leg members 110, 112, 114, 116. Therefore, when the first table portion 102 and the second table portion 104 are separated from each other (as shown in FIGS. 4 and 7) the tables 402, 404 are substantially the same height. In one embodiment, the height of the first leg portion 258 and/or the second leg portion 260 can be adjusted.

The second leg portion 260 also includes an upper surface 264 that is configured to receive a bottom portion 266 of the corresponding first table portion leg member 110 when the first leg portion 258 is mated/inserted into the channeled portion 346 (see FIG. 3). Stated differently, the first table portion leg members 110, 112, 114, 116 rest on top of the second leg portions 260 of their corresponding second table portion leg members 128, 130, 132, 134. The configuration of the first leg portion 258 being situated on the second leg portion 260 so that they have a common face 262 and the second leg portion 260 having a width w and a depth d that is substantially similar to a width w and a depth d of the corresponding first table portion leg member 110, allows the second table portion leg member 130 to be situated flush with respect to its corresponding first table portion leg member 110 when mated/inserted therewith. The mated leg members 110, 130, (see FIGS. 1 and 2) thereby more closely appear as one unified leg member of a single table. The other leg members 112, 114, 116 of the first table portion 102 when mated with the other leg members 130, 132, 134, of the second table portion 104 similar to the discussion above with respect to mated leg members 110, 130, also appear as unified leg members of a single table, as shown in FIG. 1.

For example, FIG. 2 shows the second table portion leg member 128 being inserted into the channeled portion 352 (not shown in FIG. 2) of the first table portion leg member 116. As can be seen, the common face 262 existing between the first leg portion 258 and the second leg portion 260 of leg member 128 is flush with each edge 268, 270 to the side of the channeled (or pocketed, slotted, or hollowed) portion 352 (better shown in FIG. 3). The remaining sides of the second leg portion 260 are also flush with the corresponding sides of the first table portion leg member 116. This configuration is advantageous because even though two table portions 102, 104 are coupled together, as shown in FIG. 1, the leg members 128, 130, 132, 134 of the second table portion 104 are hidden within corresponding leg members 110, 112, 114, 116 of the first table portion 102. This gives the visual appearance of a single continuous table 100 as shown in FIG. 1.

FIG. 2 also shows that the upper region 106 of the first table portion 102 comprises a first upper region portion 272 and a second upper region portion 274. The first upper region portion 272 is slidably coupled to the second upper region portion 274 via a plurality of sliding members 276, 278. It should be noted that although FIG. 2 shows a plurality of sliding members 276, 278 a single sliding member can also be implemented as well. The sliding members 276, 278 extend from the first upper region portion 272 into a corresponding channel 280, 282 of the second upper region portion 274. The sliding members 276, 278 are configured to slide in and out of the channels 280, 282. For example, FIG. 1 shows the first upper region portion 272 and the second upper region portion 274 coupled together, e.g., the sliding members 276, 278 have been slid into the channels 280, 282, whereas FIG. 2 shows the first upper region portion 272 and the second upper region portion 274 separated, e.g., the sliding members 276, 278 have been slid out of the channels 280, 282, thereby separating the first upper region portion 272 and the second upper region portion 274 along with the first table portion leg members from the second table portion leg members. In other words, the leg members 128, 130, 132, 134 that are mated with the channeled portion 346, 348, 350, 352 of the other leg members 110, 112, 114, 116 are separated from the channeled portions 346, 348, 350, 352 so that the first table portion 102 can be lifted off of the second table portion. This sliding ability enables the first table portion 102 and the second table portion 104 to be removed from each other as shown in FIG. 4 and/or coupled together as shown in FIG. 1. Additionally, in one embodiment, a height of the second leg portion 260 of each of the leg members 128, 130, 132, 134, of the second table portion 104, can be selected to be small. For example, the small height of the second leg portion 260 can be set to approximately less than 6 inches, and more preferably to approximately 3 inches or 4 inches. This small height of the second leg portion is approximately the height at which one or two users of the convertible table 100 would lift the first table portion 102 off of the second table portion to convert the table 100 into, for example, two separate tables 102, 104. Most people could easily lift the table 100 by such a small height, even if the table is made of relatively solid wood and/or quality materials that can be somewhat heavy to move.

On the other hand, certain types of tables that can be stacked on top of each other for storage, would need to be lifted to a large height, such as at least a height of an entire table. These types of stackable tables therefore are not easily lifted from each other, except in the case of tables that are very lightweight and typically made of thin plastic. These types of tables typically look and feel cheap and are commonly used outdoors around pools, lawns, and deck areas.

Figure 5:
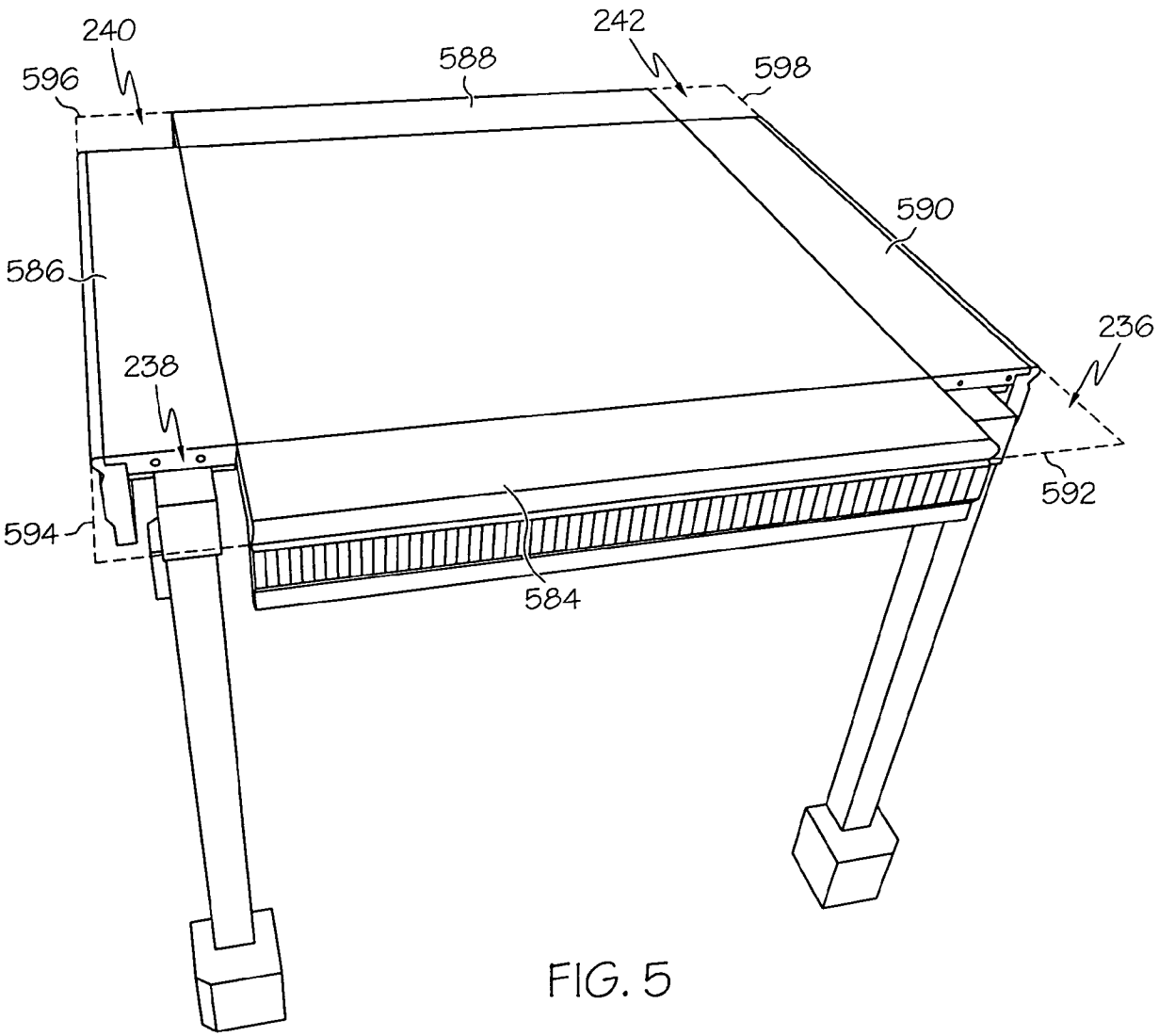
FIG. 5 is a perspective view of the convertible table shown in FIG. 2, showing the second table portion being viewed from a different angle than that shown in FIG. 2.

Referring back to FIG. 5, according to one embodiment, the outer portions 584, 586, 588, 590, of the second table portion 104 are configured to fit in between corresponding leg members of the first table portion 102 when the first table portion 102 the second table portion 104 are coupled together (as shown in FIG. 1). For example, FIG. 5 shows that a cutout (or recessed) area denoted by the dashed boxes 592, 594, 596, 598 is disposed at each corner area 236, 238, 240, 242 of the second table portion 104. These cutout (or recessed) areas of the second table portion 104 are configured to receive corresponding leg members 110, 112, 114, 116, of the first table portion 102. The cutout (or recessed) areas 592 and 594 enable the outer portion 584 of the second table portion 104 to be situated between leg members 110 and 116 of the first table portion 102 when the first table portion 102 and the second table portion 104 are coupled together (as shown in FIG. 1). The cutout areas 594 and 596 enable the outer portion 586 to be situated between leg members 110 and 112. The cutout areas 596, 598, enable the outer portion 588 to be situated between the leg members 112, 114. The cutout areas 598, 592 enable the outer portion 590 to be situated between the leg members 114, 116.

In one embodiment, the width w and depth d of the first table portion leg members 110, 112, 114, 116 is substantially the same size as the cutout areas 592, 594, 596, 598. Therefore, when the first table portion 102 and the second table portion 104 are coupled together (as shown in FIG. 1), the outer portions 584, 586, 588, 590 of the second table portion 104 meet each other. In another embodiment, the width w and depth d of the first table portion leg members 110, 112, 114, 116 can be smaller than the cutout areas 592, 594, 596, 598.

According to one embodiment, a corner cutout covering member 265 (FIG. 2) can be disposed on each of the leg members 110, 112, 114, 116, of the first table portion to substantially appear to connect the outer portions 584, 586, 588, 590 of the second table portion 104 when the first and second table portions 102, 104 are coupled together, such as to form what appears to be a single unified table. Compare FIGS. 1, 2, 4, and 5. This corner cutout covering member 265 on each of the leg members 110, 112, 114, 116, in one embodiment, includes a decorative pattern that substantially matches at least a decorative pattern of an apron portion of the second table portion 104, which can add a decorative appearance of an extended apron of the single unified table. In other words, the corner cutout covering member 265 appears to combine the decorative pattern of an apron portion of the first table portion 102 with the decorative pattern of an apron portion of the second table portion 104. When the two table portions 102, 104, are coupled together, such as to form what appears to be a single unified table, the decorative pattern of an apron portion of the first table portion 102 substantially matches with the decorative pattern of an apron portion of the second table portion 104, to form what appears as an extended apron of the single unified table. See FIG. 1.

Figure 6:
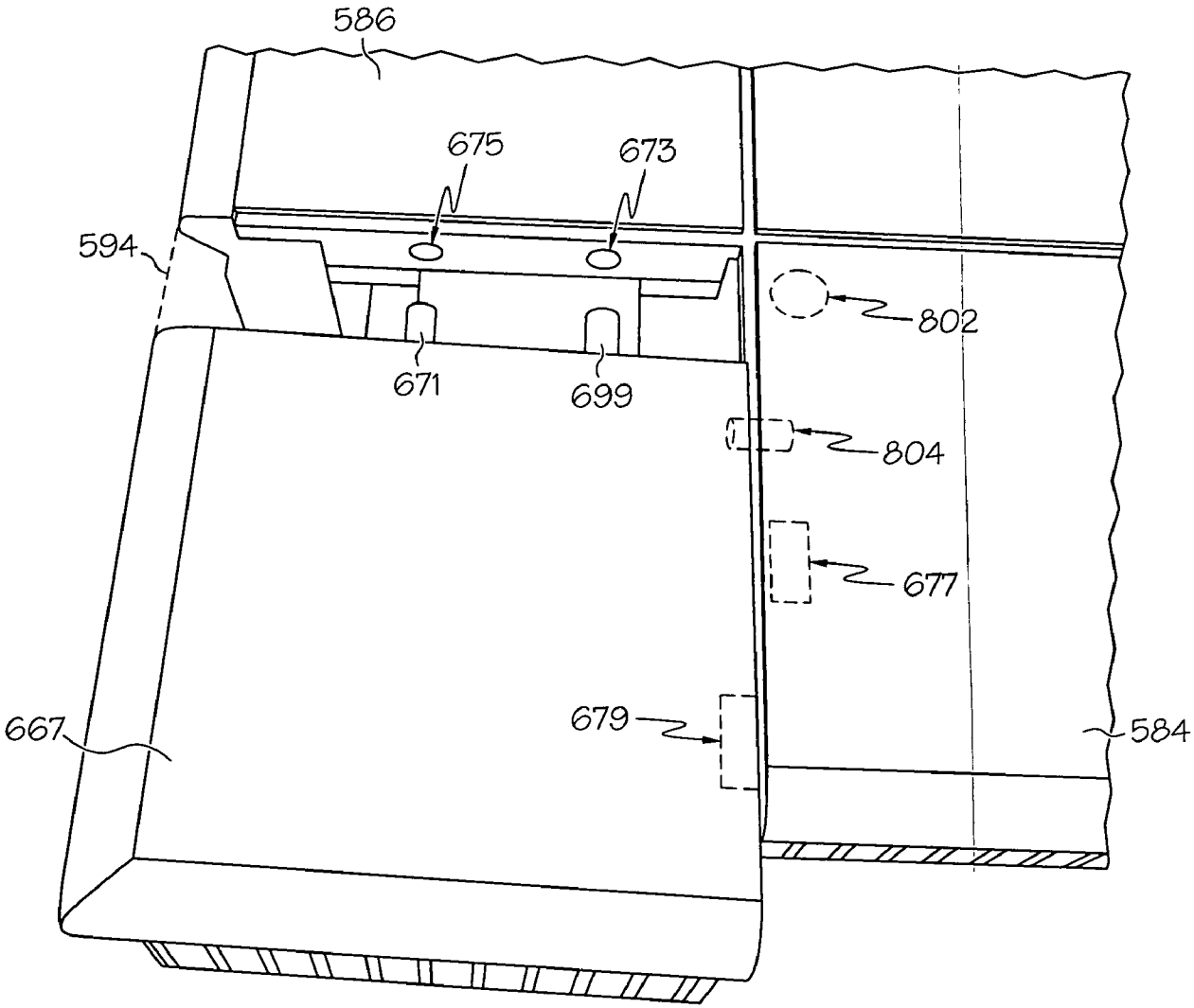
FIG. 6 is a top side perspective view of the second table portion shown in FIG. 5, specifically showing an insertable member about a corner region of the second table portion, according to one embodiment of the present invention.
Figure 8B:
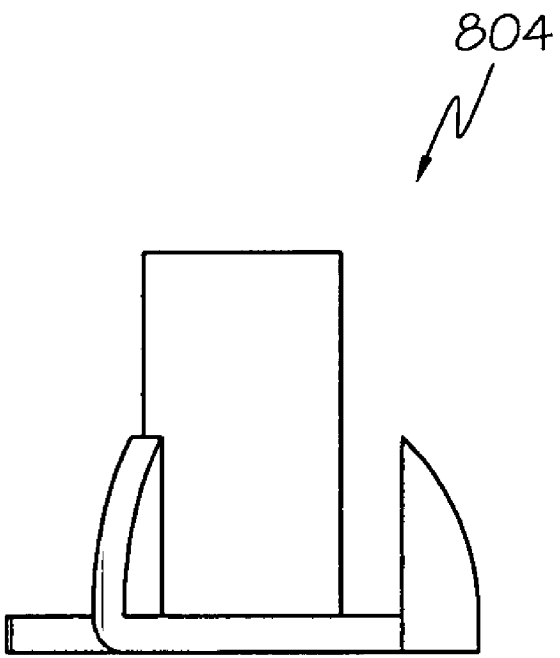
FIGS. 8A (top view) and 8B (side view) illustrate an example of a locking mechanism for use to secure the insertable member to the second table portion as shown in FIG. 6, according to one embodiment of the present invention.
Figure 8A:
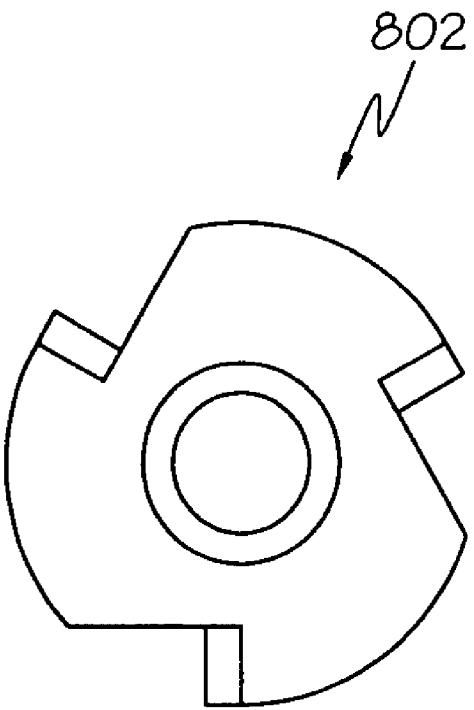

In one embodiment, when the table portions 102, 104 are separated from each other so as to create two separate tables 402, 404 (FIG. 4) or are adjoined, or abutted side by side, to create one expanded table 702 (FIG. 7) an insertable member 667 (FIG. 6) can be inserted into the cutout areas 592, 594, 596, 598 (FIG. 5) of the second table portion 104. The insertable member 667, in one embodiment, has a substantially similar aesthetic design to the remainder of the second table portion 104 so as to create a seamless appearance. For example, the insertable member 667 includes a substantially similar top surface and apron as does the first table portion 102 and the second table portion 104. The insertable member 667, in one embodiment, is coupled to the corresponding outer portions 584, 586, 588, 590 via one or more fastening members 669, 671 such as dowels or rods that mate with corresponding holes/grooves/slots 673, 675 in the outer portions 584, 586, 588, 590 of the second table portion 104. It should be noted that any fastening mechanism can be used as long as the insertable member 667 is removable and reusable. For example, a magnet 677 and a corresponding metal insert 679, as shown in FIG. 6, attract each other and secure and fasten by magnetic force the insertable member 667 to the corresponding outer portion 584, 586, 588, 590 of the second table portion 104. Additionally, a mechanical locking mechanism 802, 804, as shown in FIG. 6 and shown in more detail in FIGS. 8A and 8B, can be used about an underside of the second table portion 104 and the insertable member 667 to lock and secure the insertable member 667 when inserted into the respective cutout area 592, 594, 596, 598 (FIG. 5) of the second table portion 104. A rotating latch mechanism 802 can be moved in a rotating motion to catch an edge of a locking bar 804, and thereby fastening the insertable member 667 to the second table portion 104.

Also, removable members (not shown) can be coupled to each of the second table portion leg members 128, 130, 132, 134, so that the second table portion leg members 128, 130, 132, 134, substantially resemble the first table portion leg members 110, 112, 114, 116, when the table portions 102, 104 are used separately as two separate and distinct tables and/or are adjoined side-by-side as one expanded larger table. These removable members, for example, could include decorative cover pieces that mate with and cover the first leg portion 258 of each of the leg members 128, 130, 132, 134, of the second table portion 104.

As can be seen from the above discussion, the convertible table of the various embodiments is advantageous over conventional tables because separate one or more leaves, or foldable portions, are not required. The surface area of the table is able to be substantially increased (e.g. double in size) while maintaining ease of use and a relatively small foot-print.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A configurable table arrangement comprising:

a first table portion comprising:

a first upper region; and a first plurality of leg members disposed perpendicular to the first upper region and extending from an underside of the first upper region; and a second table portion comprising:

a second upper region; and a second plurality of leg members disposed perpendicular to the second upper region and extending from an underside of the second upper region, and wherein at least one leg member of the first plurality of leg members and at least one leg member of the second plurality of leg members are matched to each other, and wherein one of two matched leg members comprises a channeled portion along a length of the leg member and the other one of the two matched leg members comprises a mating portion along a length of the leg member such that the channeled portion and the mating portion are configured to mate with each other, and wherein the first upper region comprises:

a first portion and a second portion, wherein the first portion is slidably coupled to the second portion via a plurality of sliding members, and wherein the first portion comprises a first leg member and a second leg member of the first plurality of leg members, wherein the first leg member and the second leg member are disposed on opposite ends of the first portion of the first upper region.

2. The configurable table arrangement of claim 1, wherein one of the first leg member and the second leg member of the first plurality of leg members is one of the two matched leg members configured to mate with each other.

3. The configurable table arrangement of claim 1, wherein when two matched leg members are mated with each other an exposed face of one of the two matched leg members is substantially flush with an adjacent edge of the other one of the two matched leg members.

4. The configurable table arrangement of claim 1, wherein the at least one leg member of the first plurality of leg members and the at least one leg member of the second plurality of leg members, when mated together, appear as one leg member of a single unified table comprising the first table portion mounted on the second table portion.

5. The configurable table arrangement of claim 4, wherein the at least one leg member of the first plurality of leg members comprises a corner cutout covering member that includes a decorative pattern that substantially matches a decorative pattern of an apron portion of the second table portion.

6. The configurable table arrangement of claim 1, wherein the other one of the two matched leg members comprises a first leg portion and a second leg portion disposed under the first leg portion, and wherein the first leg portion comprises the mating portion that mates with the channeled portion of the one of the two matched leg members.

7. The configurable table arrangement of claim 6, wherein a width and a depth of the second leg portion of the one of the two matched leg members is substantially identical to a width and depth of the other one of the two matched leg members.

8. The configurable table arrangement of claim 6, wherein a height of the second leg portion of the one of the two matched leg members is less than 6 inches.

9. The configurable table arrangement of claim 1, wherein the first table portion and the second table portion are separable from each other to create two separate and distinct tables.

10. The configurable table arrangement of claim 9, wherein with the first table portion and the second table portion being separated into two separate and distinct tables, when the two separate and distinct tables are located abutting each other on a flooring a first side of the first upper region abuts a first side of the second upper region such that the abutting two tables form a single expanded table.

11. The configurable table arrangement of claim 10, wherein the first upper region and the second upper region are substantially flush with each other when the first side of the first upper region abuts the first side of the second upper region.

12. The configurable table arrangement of claim 1, wherein the second upper region of the second table portion comprises a recessed area disposed on each corner of the second upper region, wherein each recessed area is configured to receive a corresponding leg member of the first plurality of leg members.

13. A configurable table comprising:

a first table portion comprising a first upper region; and a second table portion comprising a second upper region, wherein the first table portion is situated on top of the second table portion, and wherein the first table portion comprises:

a first plurality of leg members disposed perpendicular to the first upper region and extending from an underside of the first upper region, wherein each leg member comprises a channeled portion along a length of each leg member; and wherein the second table portion comprises:

a second plurality of leg members disposed perpendicular to the second upper region and extending from an underside of the second upper region, wherein each leg member of the second table portion comprises a mating portion along the length of the leg member such that the channeled portion and the mating portion are configured to mate with each other, wherein each leg member of the first plurality of leg members and each leg member of the second plurality of leg members, when mated with each other, appear as one leg member of a single unified table comprising the first table portion on the second table portion, and wherein the second upper region of the second table portion comprises a recessed area disposed on each corner of the second upper region, wherein each recessed area is configured to receive a corresponding leg member of the first plurality of leg members.

14. The configurable table of claim 13, wherein each leg member of the first plurality of leg members comprises a corner cutout covering member that includes a decorative pattern that substantially matches a decorative pattern of an apron portion of the second table portion.

15. The configurable table of claim 13, wherein the first upper region comprises:

a first portion and a second portion, wherein:

the first portion is slidably coupled to the second portion via a plurality of sliding members, the first portion comprises a first leg member and a second leg member of the first plurality of leg members, and the first leg member and the second leg member are disposed on opposite ends of the first portion of the first upper region.

16. The configurable table of claim 13, wherein:

each of the leg members in the second plurality of leg members comprises a first leg portion and a second leg portion disposed under the first leg portion, the first leg portion mates with the channeled portion of a corresponding leg member of the first plurality of leg members, and the second leg portion is configured to receive a bottom portion of the corresponding leg portion on an upper surface of the second leg portion as the first leg portion mates with the channeled portion.

17. The configurable table of claim 16, wherein a width and a depth of the second leg portion is substantially identical to a width and depth of the corresponding leg member of the first plurality of leg members.

18. The configurable table of claim 13, wherein the first table portion and the second table portion are separable to create two separate and distinct tables.

19. A method of configuring a table into two separate tables, and vice versa, the method comprising:

sliding a first portion of a first table away from a second portion of the first table unit, wherein the first table unit is disposed on top of a second table unit, and wherein each of the first table unit and the second table unit comprises an upper table region and a plurality of leg members disposed perpendicular to, and extending from an underside of, the upper table region;

separating at least one of the plurality of leg members of the first table unit from at least one of the plurality of leg members of the second table unit, wherein the separating comprises separating a mating portion of one leg member of one of the first table unit and the second table unit from a channeled portion of one leg member of the other one of the first table unit and the second table unit;

lifting, after the separating, the first table unit from the second table unit;

placing, after the lifting, the first table unit and the second table unit on a flooring surface in one of:

a non-adjacent configuration creating two separate and distinct tables; and adjacent to each other where an edge portion of the upper table region of the first table unit and an edge portion of the upper table region of the second table unit substantially abut each other thereby creating a single larger table.

20. The method of claim 19, further comprising:

lifting the first table unit from the flooring surface;

placing the first table unit onto the second table unit;

mating at least one of the plurality of leg members of the first table unit and the second table unit with a corresponding one of the plurality of leg members of the other one of the first table unit and the second table unit, wherein the mating comprising inserting a mating portion of at least one leg member of the plurality of leg members of one of the first table unit and the second table unit into a channeled portion of at least one leg member of the plurality of leg members of the other one of the first table unit and the second table unit; and sliding the first portion of the first table unit toward the second portion of the first table unit.

* * * * *